US009631798B2

(12) United States Patent
Barry

(10) Patent No.: US 9,631,798 B2
(45) Date of Patent: Apr. 25, 2017

(54) ADJUSTABLE TWO BULB LAMP ADAPTER

(71) Applicant: Paul Abell Barry, Louisville, KY (US)

(72) Inventor: Paul Abell Barry, Louisville, KY (US)

( * ) Notice: Subject to any disclaimer, the term of this patent is extended or adjusted under 35 U.S.C. 154(b) by 0 days.

(21) Appl. No.: 14/755,282

(22) Filed: Jun. 30, 2015

(65) Prior Publication Data

US 2015/0377457 A1 Dec. 31, 2015

Related U.S. Application Data

(60) Provisional application No. 61/998,469, filed on Jun. 30, 2014.

(51) Int. Cl.

| | |
|---|---|
| ***F21V 19/02*** | (2006.01) |
| ***F21V 19/00*** | (2006.01) |
| *F21V 21/30* | (2006.01) |
| *H01R 33/90* | (2006.01) |

(52) U.S. Cl.

CPC ..... *F21V 19/02* (2013.01); *F21V 19/0065* (2013.01); *F21V 21/30* (2013.01); *H01R 33/90* (2013.01)

(58) Field of Classification Search

CPC ..... F21V 19/02; F21V 19/0065; F21V 21/30
USPC ..... 362/426, 427, 428, 429
See application file for complete search history.

(56) References Cited

U.S. PATENT DOCUMENTS

| | | | | |
|---|---|---|---|---|
| 2,231,565 | A * | 2/1941 | De Reamer | H01R 33/94 362/421 |
| 4,835,748 | A | 5/1989 | Krause, Jr. | |
| 2008/0261427 | A1 | 10/2008 | Adams | |
| 2011/0189894 | A1* | 8/2011 | Hirsh | F21V 19/006 439/620.02 |

OTHER PUBLICATIONS

SATCO Two Light Socket Adapter 150 W Medium, Satco Part No. 77607, rendered by Amazon.com, first time noticed Jan. 26, 2014 in US by applicant.

* cited by examiner

*Primary Examiner* — Vip Patel

(57) ABSTRACT

This adjustable two bulb lamp adapter is an electrical device with a male threaded light bulb type base to permit use of two low energy CFL bulbs in place of and function as a three-way incandescent light bulb in existing shade lamps. The adapter embodies two bulb holders with limited and independent rotational adjustment in a plane parallel to the axis of the threaded base. An integral thumb wheel permits rotating and securing the adapter base into the receiving socket while the two bulbs are held in a fixed position. An included adjuster allows utilization as a two bulb adapter for a single filament bulb type socket. These adjustments provide means to optimize fit and light distribution in existing lamp shades and other applications. The concept of using the adapter's adjustable two bulb sockets greatly enhances selecting lower energy CFL bulbs to achieve higher levels of illumination in more applications than available in fixed adapters.

4 Claims, 6 Drawing Sheets

ADJUSTABLE TWO BULB LAMP ADAPTER

This application claims priority from U.S. Provisional application No. 61/998,469 filed on Jun. 30, 2014

BACKGROUND

This invention fills the need for an adapter to provide to the ubiquitous three-way incandescent lamp holder a means to allow replacement of a two filament incandescent electric light bulb with an electrical device containing two separate adjustable light bulb holders permitting continued use of the existing four position switching mechanism to function as a three-way lamp holder. The higher energy consumption of the three-way incandescent light bulb can be replaced by two energy efficient Compact Fluorescent Light (CFL) bulbs with the same three-way functioning and thus eliminate the need to replace the higher cost three-way CFL if one level fails. Other two bulb adapters are available however mechanisms are not being supplied to adjust the adapter to the three-way switching means in the widely used four position switched lamp holder. This invention can also be adjusted for use in a single filament type lamp socket for improving light intensity by using two CFL bulbs. This invention embodies rotating sockets and rotating base which improve over existing two bulb adapters by permitting configuration adjustments to accommodate the confinements encountered in lamp shade shapes and mounting hardware. These features allow positioning bulbs to provide optimum directing for lighting needs.

BRIEF SUMMARY OF THE INVENTION

1. A two bulb holder lamp adapter with each holder separated for independent rotation, closely positioned near the male screw base and with electrical connections to allow each bulb holder limited rotation in a plane parallel or nearly parallel to the axis of the adapter base threads. With the invention positioned in a normal upright attitude, this feature allows each of the two bulb holders to be independently rotated to positions from vertical to below horizontal to achieve optimum distribution of lighting effects from the two bulbs and to be positioned if necessary to avoid possible interferences to any original lamp hardware. The invention adapter may be installed in any position corresponding to the required positioning of the receiving bulb socket. This provision will also permit positioning of each bulb to achieve optimum clearance between an existing shade and the bulb for heat related safety concerns.

2. A two bulb holder lamp adapter fitted with a male screw base shaped to replicate the electrical contact elements of a two filament light bulb base and incorporated therein with electrical provisions for an adjustable shunt for selecting, prior to installation, the current path to cause the invention adapter to operate as a two filament bulb with two separate single filament bulbs installed. This arrangement allows each separate single filament bulb to replace each separate filament of a two filament light bulb. The same shunt can also be adjusted to a current path to permit the adapter to operate the two single filament bulbs both "on" or "off" simultaneously when installed in a conventional lamp holder with a two position switch normally used for single filament light bulb operation or installed in a lamp holder with a four position switch normally for a two filament light bulb operation. A simple single pole electric switch to permit the aforementioned functions can be substituted for the adjustable shunt by installing said switch at at some location selected away from the male screw base.

3. A two bulb holder lamp adapter with a single male screw base fitted with electrically conducting metal collector rings and contactors to permit the invention lamp adapter to be installed into an existing lamp holder by turning an integral insulated "thumb wheel" attached to the conducting screw threads of the adapter base. This feature allows the invention adapter to be installed into electrical connection while the position of the two bulb holders can held in a preselected location. This improvement permits installation of the invention adapter into confined spaces such as would be encountered in a lamp holder containing a shade with a harp type support in place. With these provisions the two bulb unit can also be rotated in a carousel fashion in a plane located at or near 90 degrees to the axis of the adapter base threads with no stop limits required and locked into final position by tightening the "thumb wheel".

4. The provision of a spring loaded device on the supporting mechanism of the rotatable bulb holder is incorporated to offer adequate rotational resistance to allow each bulb holder to be adjusted to position without the need for an added locking-unlocking device to be operated by the user installer.

DETAILED DESCRIPTION AND BEST MODE OF IMPLEMENTATION

Figure 1:
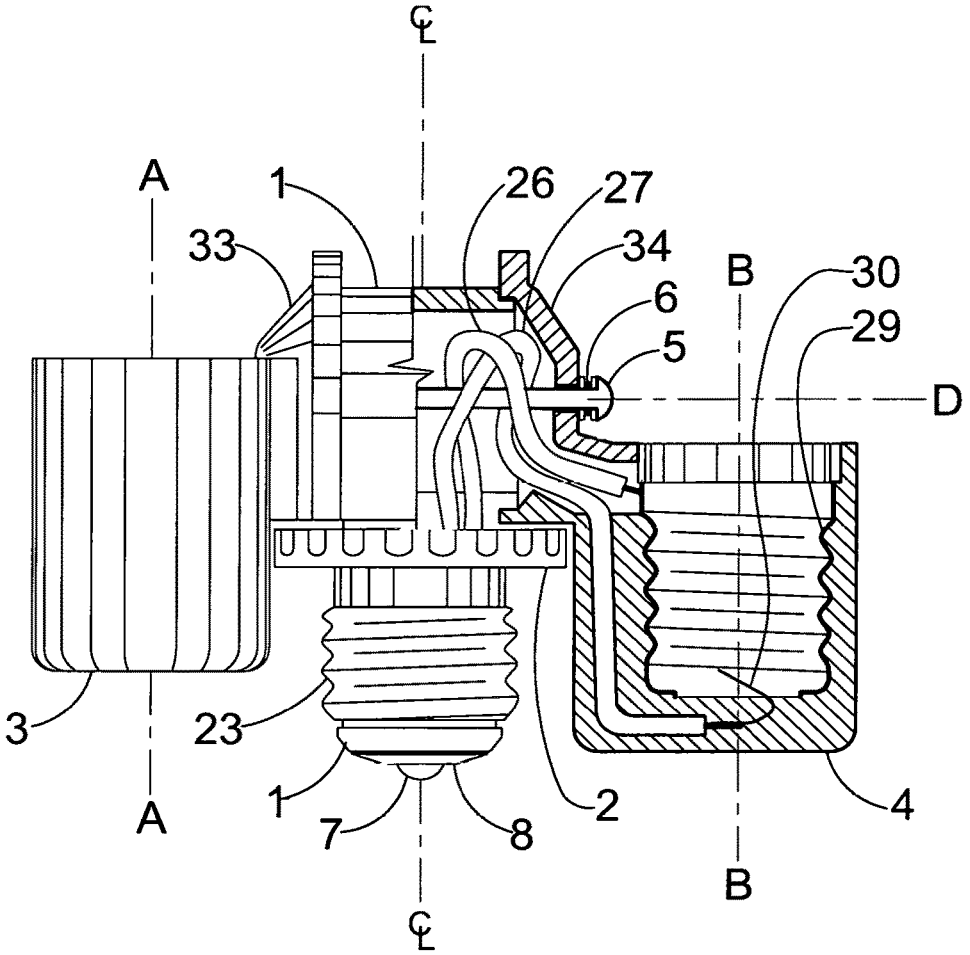
FIG. 1 is a side view of the two bulb holder lamp adapter showing the screw base and a partial cross section of one bulb holder with rotating mechanism and an external view of the opposed second bulb holder.
Figure 2:
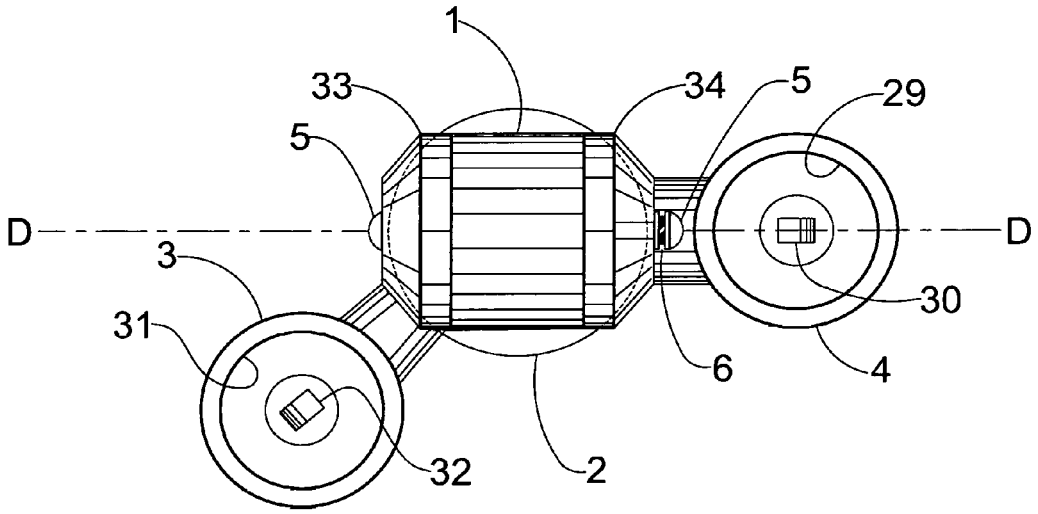
FIG. 2 is the top exterior view of lamp adapter shown in FIG. 1.
Figure 3:
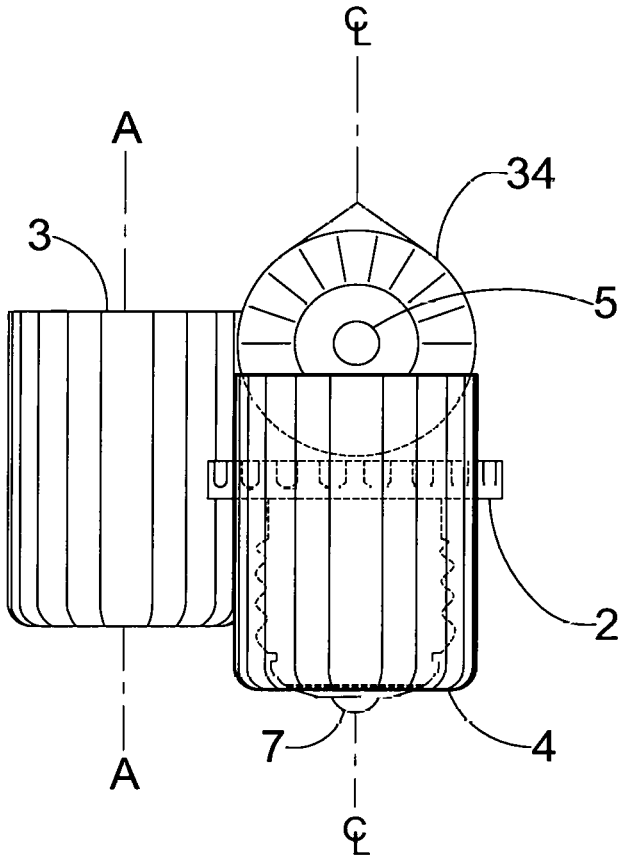
FIG. 3 is the right side exterior view of lamp adapter shown in FIG. 1.

Refer to FIGS. 1, 2 and 3. The adjustable two bulb lamp adapter consists of the main components comprising the body 1, cylindrical element 2 with attached screw shell 23 (which is the major portion of a three way light bulb base) and two bulb holders 3 and 4 each constructed of a suitable material having sufficient strength, endurance and electrical insulating properties to safely support metal conductors, light bulbs and metal connecting parts. The subject adjustable two bulb lamp adapter will be referred to as the adapter or the adjustable two bulb lamp adapter in the following specifications.

Refer to FIG. 1. FIG. 1 displays the adjustable two bulb lamp adapter in a front view with a cross sectional view of bulb holder 4 and a partial cross sectional view of the upper portion of body 1 included. The two bulb holders 3 and 4 are held in contact with body 1 by pivot rod 5. Pivot rod 5 provides a shaft about which socket holders 3 and 4 can rotate within preset limits. The body 1 extends from the bottom to the top and is the main support structure. The body 1 having a cylindrical shape on the lower end for holding a three way light bulb base comprising elements 1, 2, 7, 8, 23 having exact dimensions to allow installation into the receiving socket of an electric lamp fixture. What is different is the adapter three way light bulb base is modified to incorporate two separated components to allow the threaded shell 23 to rotate freely around the lower portion of adapter body 1.

Figure 4:
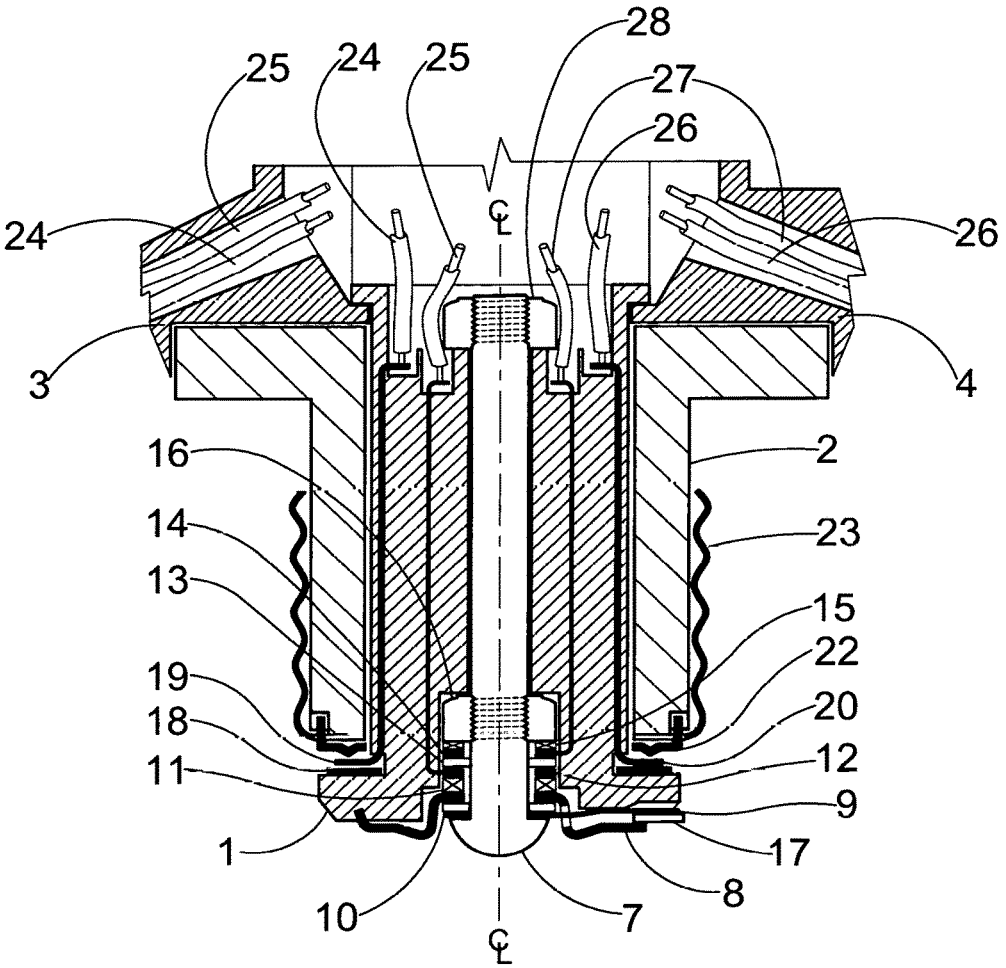
FIG. 4 is a cross sectional view of the adapter screw base showing details of electrical embodiments allowing independent rotation of the screw portion of the base during installation and removal of invention.
Figure 5:
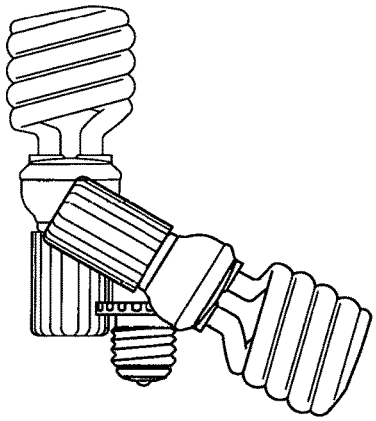
FIG. 5 is a view of lamp adapter shown in FIG. 3 with CFL bulbs installed and one bulb holder positioned vertically and the other rotated below horizontal.
Figure 6:
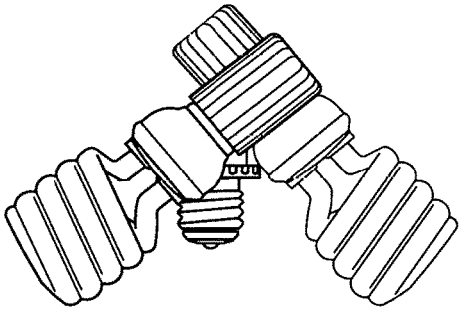
FIG. 6 is view of lamp adapter shown in FIG. 3 with CFL bulbs installed and both bulb holders rotated below horizontal.
Figure 7:
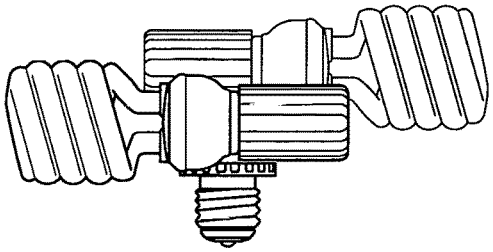
FIG. 7 is a view of lamp adapter shown in FIG. 3 with CFL bulbs installed and both bulb holders rotated to the horizontal position.
Figure 8:
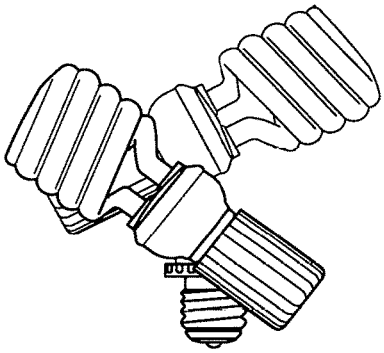
FIG. 8 is a view of lamp adapter shown in FIG. 3 with CFL bulbs installed and both bulb holders rotated to positions between vertical and horizontal.

Refer to FIG. 4. This drawing is a cross section view of the three way light bulb base which is the lower portion of the adapter body 1 (FIG. 1 shows the three way light bulb base with comprising elements 1, 2, 7, 8 & 23). The elements shown are electrical conductors or electrical insulators and have the purpose of providing paths for electric current to travel from the receiving socket of an electric light fixture to the adapter's light bulb holders 3 and 4. The base of a three way light bulb incorporates three electrical connections to energize two separate filaments in a three way light bulb. The outer threaded shell is the common electrical connection and the center tip provides for the first hot electrical connection and an intermediate ring, which adjoins the center tip, provides for the second hot electrical connection. These connections as they apply to the adjustable two bulb lamp adapter are described by the following four paragraphs for reference to FIG. 4.

The center electrode 7 is a fixed electrical conductor and is for connection to the first electrical hot connection in a receiving bulb socket of an electric light fixture. Electrode 7 is electrically isolated except for the electrical connections providing a current path to center hot connection 30 in bulb holder 4. The current path is through conducting elements listed in the following: electrode 7 connected to the tension nut 16 connected to lock washer 15 connected to ring strip 14 connected to flexible conductor 27 connected to center hot connection 30 of bulb socket in bulb holder 4.

The intermediate ring 8 is a fixed electrical conductor and is for connection to the second electrical hot connection in a receiving bulb socket of an electric light fixture having a four position switch for energizing a three way light bulb. Intermediate ring 8 is electrically isolated except for electrical connections providing a current path to center hot connection 32 in bulb holder 3. The current path is through conducting elements listed in the following: intermediate ring 8 connected to ring 11 connected to ring strip 12 connected to flexible conductor 25 connected to center hot connection 32 of bulb socket in bulb holder 3.

Threaded shell 23 is permanently fixed to cylindrical element 2 and is for threading insertion into the receiving bulb socket of an electric light fixture whereby connecting to the electrical common connection of the receiving bulb socket. Cylindrical element 2, with threaded shell 23 attached, is positioned centered on a cylindrical portion at bottom of body 1 and is free to rotate in either direction. Threaded shell 23 is electrically isolated except for electrical connections providing a current path to the common electrical connection of the threaded shell 29 in bulb holder 4 and simultaneously connecting to the common electrical connection of the threaded shell 31 in bulb holder 3. The current path to bulb holder 4 Is through conducting elements listed in the following: threaded shell 23 connected to ring 22 connected by sliding contact to foot strip 20 connected to flexible conductor 26 connected to internally threaded shell 29 of bulb holder 4. The current path to bulb holder 3 is through conducting elements listed in the following: threaded shell 23 connected to ring 22 connected by sliding contact to foot strip 19 connected to flexible conductor 24 connected to internally threaded shell 31 of bulb holder 3.

Cylindrical element 2 is shaped on the upper end to have a ring flange configuration extending outward to serve as a wheel like device (also called a thumb wheel) to be grasped by human fingers to rotate attached threaded shell 23 for screw threading installation and removal from a lamp fixture light bulb socket. (FIGS. 1, 2 and 3 have the number 2 lined to the said ring flange which is an integral part of cylindrical element 2) This embodiment allows installation and removal of the adjustable two bulb lamp adapter by only rotating cylindrical element 2 (with attached threaded shell 23) while holding the upper portion of adapter against rotating. This is advantageous for situations where rotating entire adapter is restricted by closely positioned lamp parts such as a lamp shade support harp.

FIG. 1 includes a partial cut away cross section of bulb holder 4 with an internally threaded screw shell 29 and center contact 30 for receiving a single filament electric light bulb. FIG. 1 includes a partial cut away section of upper section of body 1 displaying flexible conductor 26 connected to internally threaded screw shell 29 and flexible connector 27 connected to center contact 30 of bulb holder 4. (Bulb holder 3 uses flexible conductors 24 and 25 for electrical connections.)

Refer to FIGS. 1, 2 and 3. These figures show two possible configurations of the bulb holders 3 and 4. The adapter can be manufactured containing two of matching bulb holders of either type bulb holder 3 or bulb holder 4 or any other bulb holder envelope meeting the requirement for rotation. The optimum arrangement is one that positions each of the two bulb holders 3 and 4 as near as possible to the location of the adapter's three way light bulb base with out interfering with safe operation in a lamp fixture having a two position switch or a lamp fixture having a four position switch.

Refer to FIGS. 1 and 2. A compressed spring 6 is centered on pivot rod 5 to provide pressure between the integral end cap of pivot rod 5 and the housing of bulb holder 3 or bulb holder 4 to produce resistance to rotation of each bulb holder 3 or bulb holder 4. This feature eliminates the need for a locking device to secure bulb position after each rotation adjustment.

Refer to FIG. 4. The adapter incorporates a simple mechanism for a user to change the adapter to operate as a single filament bulb when installed in a lamp fixture having a two position switch. The mechanism for changing is to electrically connect center electrode 7 and intermediate ring 8. The devices to achieve this connection are shunt 9 (a conducting thin strip) and insulator plate 17. One end of shunt 9 is permanently connected to center electrode 7 and the opposite end positioned adjacent to intermediate ring 8. Insulator plate 17 is hinged captive to body 1 and when moved to topside of shunt 9, shunt 9 is forced into contact with ring 8. This allows both bulb holders 3 and 4 to receive electrical power simultaneously. (FIG. 4 shows shunt 9 and insulator plate 17 positioned to operate the adapter as a three way light bulb wherein bulb holder 3 is independently energized to simulate one filament of a three way light bulb and bulb holder 4 is independently energized to simulate the second filament of a three way light bulb when the adapter is operated in a lamp fixture having a four position switch).

Refer to FIGS. 5, 6, 7 & 8. Each of these Figures display a random position of adapter bulb holders with installed CFL bulbs. Both bulb holders 3 and 4 can be independently positioned to vertical or to any position from vertical to the respective below horizontal positions shown by rotation about pivot rod 5.

Figure 9:
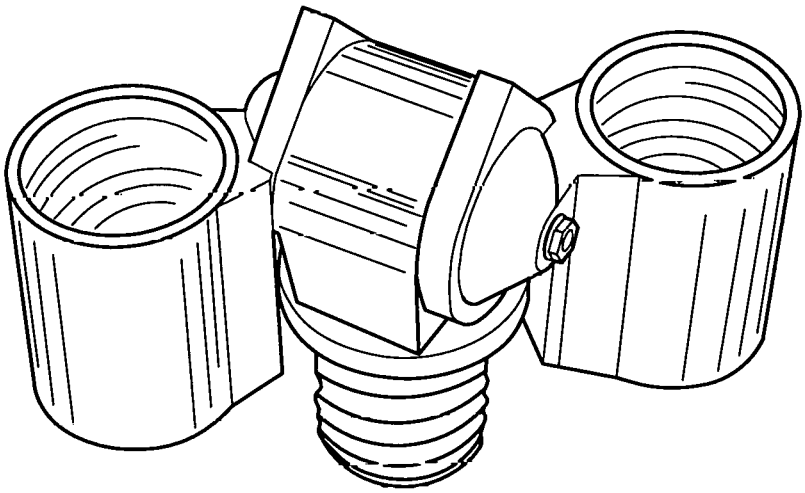
FIG. 9 is an isometric view of the lamp adapter incorporating two bulb holders of the design similar to Part 3 in FIGS. 1,2 and 3.

Refer to FIG. 9. This figure shows one of many possible configurations of the lamp adapter. The two opposed bulb holders shown are identical and similar to bulb holder 4 shown on FIGS. 1, 2 and 3. These bulb holders may be of any workable configuration and either matched or unmatched

The invention claimed is:

1. A two bulb adjustable lamp adapter comprising: a body of rigid insulative material (1) having an integral three way light bulb base (1, 2, 7, 8, & 23) for insertion into an internally threaded female socket on an electric lamp fixture; a pair of bulb holders (3 & 4) of rigid insulative material oriented in a closely spaced relation with said integral three way light bulb base and with each having an internally threaded conductive screw shell (29 & 31) and a centered conductive contact (30 & 32) for receiving the threaded base of an electric light bulb, said integral three way light bulb base, having a centerline axis, and said pair of bulb holders (3 & 4) each having an axis (A & B) with all three orientated in parallel relation at the initial position, said pair of bulb holders (3 & 4) being positioned on opposite sides of the centerline axis of said integral three way light bulb base, said pair of bulb holders (3 & 4) having flexible electrical conductors (24, 25 & 26, 27) electrically connecting to said integral three way light bulb base with each said bulb holder (3 & 4) being independently secured to said body (1) through circular elements (1, 5, 33 & 34) positioned centered on a pivot rod (5) having integral end caps, said pivot rod (5) having an axis (D) located more or less at 90 degrees to said centerline axis, said bulb holders (3 & 4) being shaped to allow rotation on said pivot rod (5) not to exceed 180 degrees total from said initial position.

2. The two bulb adjustable lamp adapter of claim 1 further comprising: an electrically conducting shunt (9) moveable for the purpose of changing operation of said adapter to function as a three way light bulb or to function as a single filament light bulb with both said bulb holders (3 & 4) simultaneously energized, said shunt (9) located closely to the second hot connection (8) of said integral three way light bulb base and having one end permanently attached to center electrical hot connection (7) and opposite end either contacting or separated from the second hot connection (8) changeable by positioning an adjoining captive moveable insulating plate (17).

3. The two bulb adjustable lamp adapter of claim 1 further comprising: said integral three way light bulb base having an outer threaded shell (23) separated for rotating around said centerline axis of said integral three way light bulb base for purpose of installing or removing said two bulb adjustable lamp adapter without the need to rotate entire said adjustable two bulb lamp adapter, said outer threaded shell (23) permanently attached to a nonconducting cylindrical element (2) having an integral wheel shaped form extending outward and removed from said outer threaded shell to permit grasping and turning by hand, said outer threaded shell (23) having electrical connection through sliding contact with an internal conducting strip (19 or 20).

4. The two bulb adjustable lamp adapter of claim 1 further comprising: said body (1) and said pair of bulb holders (3 & 1) independently secured together with said pivot rod (5); wherein the exiting portion of one end of said pivot rod (5) having a coiled compression spring (6) in compressed state centered on said pivot rod (5) between adjoining encasement of one of said pair of bulb holders (3 & 4) and the adjoining end cap of said pivot rod (5); wherein said compression spring exerting a pressure between said end cap and said encasement of one of said bulb holders (3 & 4) to cause a resisting effect against natural rotating of said pair of bulb holders (3 & 4) with respect to said body (1) after rotational repositioning of one or both of said pair of bulb holders.

* * * * *